United States Patent [19]

De Jonge

[11] 4,007,646

[45] Feb. 15, 1977

[54] MODEL VEHICLE CONTROL SYSTEM

[76] Inventor: Edward N. De Jonge, 5024 Ovid Place, San Diego, Calif. 92117

[22] Filed: May 1, 1975

[21] Appl. No.: 573,763

[52] U.S. Cl. ..... 74/501 R; 46/77

[51] Int. Cl.[2] ..... A63H 27/04

[58] Field of Search ..... 74/501 R; 46/202, 210, 46/77

[56] References Cited

UNITED STATES PATENTS

| | | | |
|---|---|---|---|
| 2,388,478 | 11/1945 | Garber | 46/77 X |
| 2,416,805 | 3/1947 | Walker | 46/77 |
| 3,555,726 | 1/1971 | Okuma | 46/210 X |
| 3,882,632 | 5/1975 | Quinzer | 74/501 R |

FOREIGN PATENTS OR APPLICATIONS

| | | | |
|---|---|---|---|
| 911,223 | 7/1946 | France | 46/77 |
| 913,329 | 9/1946 | France | 46/77 |
| 1,089,376 | 3/1955 | France | 46/77 |
| 54,970 | 6/1951 | France | 46/77 |
| 235,592 | 4/1945 | Switzerland | 46/77 |

*Primary Examiner*—Everette A. Powell, Jr.
*Attorney, Agent, or Firm*—Brown & Martin

[57] ABSTRACT

A control system for controlling a model vehicle on a long flexible rod which allows considerable freedom of motion of the vehicle. A hand held control unit has controls operated by both hands and by the thumbs, providing three double or two-way channels of control through cables extending along the rod. The rod is built in sections which plug together, the sections having graduated flexibility to provide the proper combination of support and freedom of movement. At the model, the cables are carried through a pivotal connection which ensures minimum change in cable length during maneuvers of the vehicle, and a spring incorporated in the connection maintains cable tension. The system is adaptable to a variety of surface travelling motorized vehicles and the rod arrangement allows competitive operation of several vehicles in close proximity.

6 Claims, 11 Drawing Figures

MODEL VEHICLE CONTROL SYSTEM

BACKGROUND OF THE INVENTION

Many systems have been developed for controlling model vehicles, such as cars, boats and the like, on a tether or by remote control means. For true remote control at extended range, radio control is the most practical, but is too expensive for wide spread use and is subject to interference in crowded frequency bands.

Rigid control connections are too restrictive and flexible connections such as strings or cables must be kept under tension for proper control. Cables running inside flexible tubes have been used, but friction is a problem and the controls tend to bind. Unsupported flexible tubes also drag on the ground, causing obstruction and retarding motion. For multiple control functions, the arrangement is completely impractical.

SUMMARY OF THE INVENTION

The control system described herein utilizes a long flexible rod held by the operator and attached to the vehicle. The rod is preferably constructed in detachable sections in the manner of a fishing rod and may be of fiber reinforced plastic, or similar material, having suitable strength and flexibility. At the controller's end is a control unit having dual hand grips with pivotal controls, each providing a dual function channel of control. Between the hand grip controls is a third two function control which is operated by the thumbs. Six flexible cables extend from the control unit through guides spaced along the rod.

At the vehicle the cables pass through a pivotal connection which minimizes the changes in cable length as the vehicle is maneuvered. The tip end of the flexible rod plugs into a sleeve at the pivotal connection and a spring in the connection maintains line tension. The rod is substantially rigid at the controller's end and increases in flexibility towards the tip, the final tip portion having reduced flexibility to ensure a firm coupling to the pivotal connection on the vehicle.

In use the rod is held in an upwardly bowed configuration and allows considerable freedom of motion from close proximity to the controller to the full extent of the rod. Since the rod is held clear of the ground, several vehicles can be operated in the same area, as for racing, and the rods can be passed over or under others as necessary for maneuvering.

The primary object of this invention, therefore, is to provide a new and improved model vehicle control system.

Another object of this invention is to provide a model vehicle control system wherein the vehicle is pivotally attached to a long flexible rod, along which the control elements are carried from a control unit at the controller's end remote from the vehicle.

Another object of this invention is to provide a model vehicle control system having a control unit with a two handed grip and providing three dual channels of control.

A further object of this invention is to provide a model vehicle control system which is adaptable to a variety of surface travelling vehicles.

Other objects and advantages will be apparent in the following detailed description, taken in conjunction with the accompanying drawings, in which.

DESCRIPTION OF THE PREFERRED EMBODIMENTS

Figure 1:
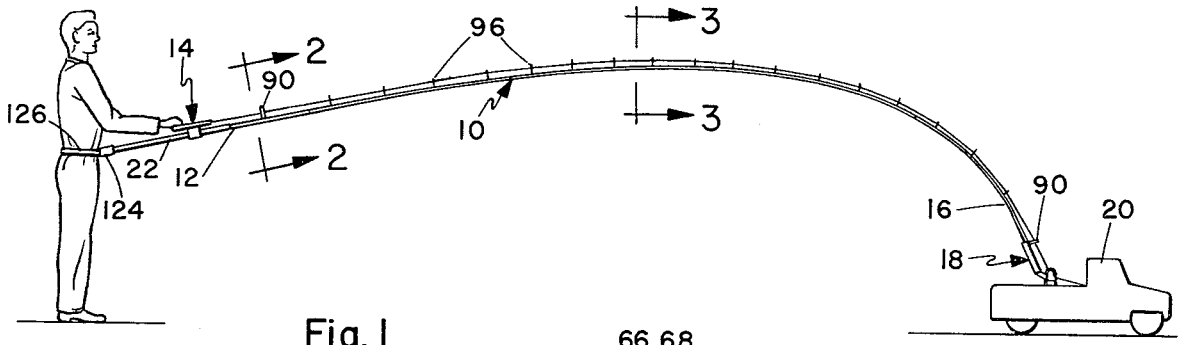
FIG. 1 illustrates the apparatus in use.

As illustrated in FIG. 1, the apparatus comprises an elongated rod 10 having a butt end 12, on which is mounted a control unit 14. The other or tip end 16 of rod 10 is attached to a connector 18 on the vehicle 20.

Figure 11:
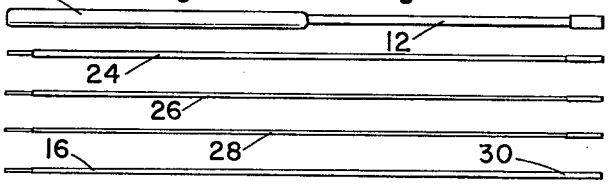
FIG. 11 illustrates the disconnected elements of the rod.

Rod 10 is composed of a plurality of sections which fit together in the manner of a fishing rod, such as by plug and socket or screw threaded connections, or the like. As illustrated in FIG. 11, the butt end section 12 has a hand grip 22 of any suitable type and is substantially rigid. The next section 24 is tapered from a near rigid portion adjoining the butt end, to a more flexible outer end portion. The third section 26 is also tapered with increasing flexibility toward the tip end. The fourth section 28 is substantially constant in cross section and is very flexible, while tip end section 16 tapers from a very flexible end to a less flexible outer end, with a substantially rigid tip 30 a few inches in length. While five rod sections are shown as an example, it will be obvious that more or less sections could be used. However, the graduated flexibility is important in order to retain handling control from the controller's end, while having sufficient flexibility near the tip for maneuvering the vehicle. It has been found that five sections, each about 4 feet in length, provides an ideal rod. The sections can be shortened to 3 feet for smaller vehicles in a more confined space.

Control unit 14 comprises a thin flat housing 32, illustrated as being generally wedge shaped in configuration, the specific shape not being critical. For convenience of manufacture, the housing is preferably split horizontally into similar top and bottom half sections 34 and 36, secured together by suitable positioned screws 37. In the wide inner end of housing 32 are hand openings 38 and 40 at opposite sides of the housing. Pivotally mounted in opening 38 is a hand grip 42, and pivotally mounted in opening 40 is a similar hand grip 44. The hand grips swing in the plane of the flat housing on hinge pins 45 journalled in the housing sections, and each has an arcuate bow portion 46 substantially enclosed in the housing.

Secured to opposite sides of hand grip 42 are flexible cables 48 and 50, the bow portion 46 having a groove 52 to contain the cables as they wrap around the bow portion when the hand grip is rotated. Secured to opposite sides of hand grip 44 are two more cables 54 and 56, the bow portion also having a groove 52 to contain the cables.

Mounted between the hand grips is a rotatable thumb wheel 58, coplanar with the hand grips. Thumb wheel 58 projects through the front wall 60 of housing 32 and has a V-shaped thumb notch 62, for engagement by the inwardly extended thumbs of hands holding the two hand grips. The thumb wheel has a circumferential groove 64 for retaining cables 66 and 68, which are secured to the thumb wheel at opposite sides of the thumb notch 62. To index the thumb wheel at selected positions, the groove 64 contains spaced sockets 70, which are engaged by a spring loaded detent 72. The detent is mounted in a central rib 74 formed in the housing. All of the cables exit the housing through individual guide sleeves 76 in rear end wall 78.

Housing 32 is attached to hand grip 22 by means of a bracket 80, which is secured to the housing by screws 82 into central rib 74. Bracket 80 has a cylindrical bore 84 through which the hand grip passes freely, and in the bore is a clamp pad 86 which is radially adjustable by means of a clamp screw 88. The control unit can thus be positioned as required on the hand grip and locked in place by tightening clamp screw 88.

Figure 2:
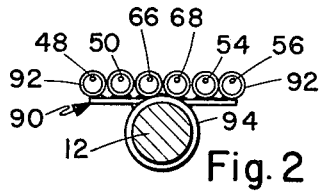
FIG. 2 is an enlarged sectional view taken on line 2—2 of FIG. 1.
Figure 3:
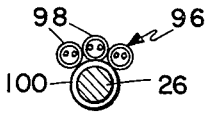
FIG. 3 is an enlarged sectional view taken on line 3—3 of FIG. 1.
Figure 5:
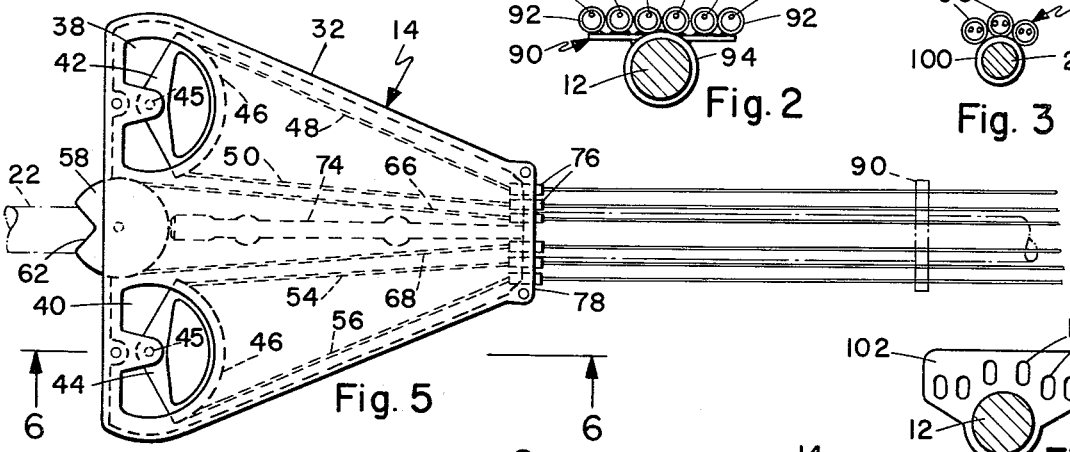
FIG. 5 is an enlarged top plan view of the control unit.

The cables are carried along the length of the rod through spaced guides, to maintain proper tension and prevent tangling. The first guide 90 adjacent the control unit has six individual tubes or rings 92 fixed to a collar 94, which is secured on butt end 12 in any suitable manner as in FIG. 2. Each cable thus passes through a separate guide ring. Along the major portion of the rod, the cables may be held in pairs in guides 96, as illustrated in FIG. 3. Guide 96 has three rings 98 fixed on a collar 100, each collar being sized to fit the particular section of rod on which the guide is secured.

Figure 4:
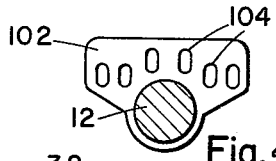
FIG. 4 is a sectional view similar to FIG. 2, showing an alternative type of cable guide.
Figure 6:
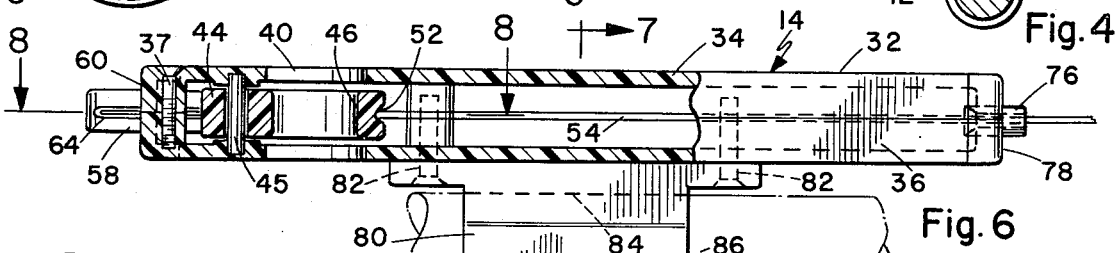
FIG. 6 is an enlarged sectional view taken on line 6—6 of FIG. 5.
Figure 7:
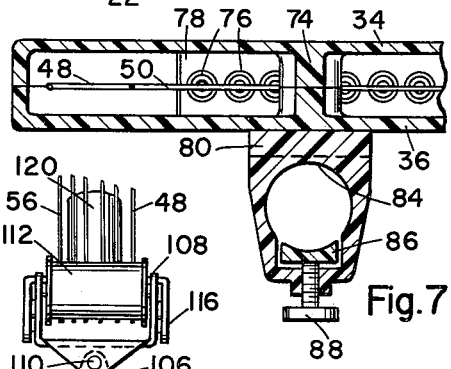
FIG. 7 is a sectional view taken on line 7—7 of FIG. 6.
Figure 8:
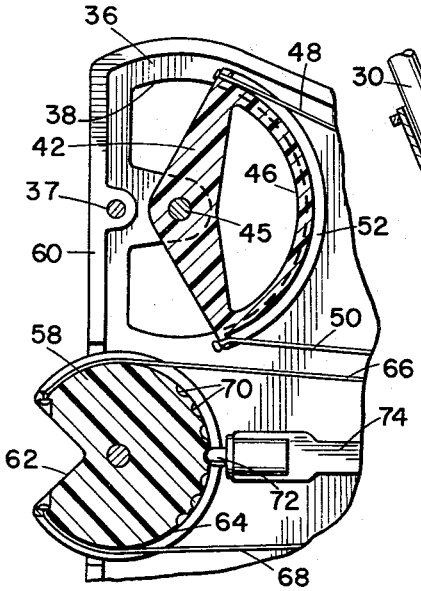
FIG. 8 is a sectional view taken on line 7—7 of FIG. 6.

An alternative guide 102, shown in FIG. 4, comprises a simple plate element having slots 104 for the cables. Other guide configurations may be equally suitable, those illustrated being examples having minimum friction.

Figure 9:
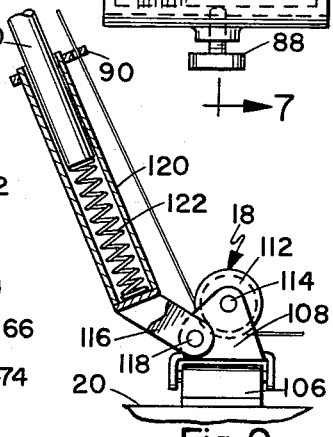
FIG. 9 is a side elevation view, partially cut away, of the pivotal connection at the vehicle.
Figure 10:
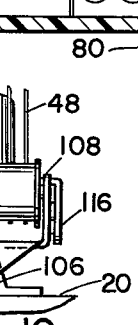
FIG. 10 is an end elevation view as taken from the right hand side of FIG. 9.

Connector 18, illustrated in FIGS. 9 and 10, includes a mounting block 106 secured at a suitable position on the vehicle. A bracket 108 is pivotally attached to mounting block 106 to swing from side to side on a hinge pin 110. Bracket 108 is substantially V-shaped and carries a roller 112, freely rotatable on a shaft 114 perpendicular to the axis of hinge pin 110. Pivotally attached to bracket 108 is a fork 116, which swings from front to rear on pins 118 parallel to the axis of shaft 114, and provides a universal joint in the connector. Extending from fork 116 is a tubular sleeve 120, in which rod tip 30 is an axial sliding fit. A compression spring 122 is fitted between tip 30 and fork 116 to maintain tension on the cables.

The axis of pins 118 is offset from shaft 114 so that the cables pass as nearly as possible through the pivot of fork 116. Thus the change in cable length is minimized as the fork pivots. On the upper end of sleeve 120 is a cable guide, preferably the individual cable separation type, such as guide 90. From there the cables extend under roller 112 into the vehicle, according to the location of the various elements to be operated, the guide 90 and the roller providing terminal guidance for the cables with minimum friction.

In the initial set up of the apparatus, the cables are all connected to the control elements in the vehicle and the rod is extended. Slack in the cables is taken up by pulling the control unit back on the hand grip until a slight load is applied to spring 122. The control unit is then locked in place by clamp screw 88 to hold the cable tension.

Functions of the controls will depend on the type and degree of controls in the vehicle. For example, one hand grip could control steering and the other hand grip could control speed through a throttle or similar means. The thumb wheel could be connected to a clutch, brake, forward and reverse mechanism, or other such means. Many different types and combinations of controls can be actuated by the three dual channels available.

For convenience the butt end 12 can be held in a pouch 124 carried on a belt 126, which is worn by the operator. With the rod thus supported, it is an easy matter to raise and lower the rod as the vehicle moves toward and away from the operator. The universal pivot at connector 18 allows considerable freedom of motion of the vehicle and rotation is accommodated by tip end 30 turning in sleeve 120. When several vehicles are being operated in the same general area, the rods can pass under or over each other. For passing, as in a race, an operator can remove the rod from pouch 124 to lift it over a competitor. The apparatus is adaptable to a variety of wheeled and water borne vehicles with various propulsion means, or to air cushion supported vehicles.

Having described my invention, I now claim.

1. A model vehicle control system, comprising:
an elongated flexible rod having a butt end and a tip end, said rod being substantially rigid at the butt end and increasing in flexibility toward the tip end;
a control unit secured on said butt end and having hand operated control means mounted therein;
a connector on said tip end with means for universal pivotal attachment to a vehicle to be controlled;
flexible cables coupled to said control means and extending along said rod to said connector;
guide means spaced along the rod for supporting said cables;
and terminal guidance means on said connector for guiding said cables into the vehicle.

2. A model vehicle control system according to claim 1, wherein said control means includes a pair of hand grips pivotally mounted in side by side relation;
a pair of said flexible cables being connected to each of said hand grips on opposite sides of the respective pivotal axis thereof.

3. A model vehicle control system according to claim 2, and including a thumb wheel pivotally mounted between said hand grips, and a further pair of said flexible cables connected to said thumb wheel on opposite sides of the pivotal axis thereof.

4. A model vehicle control system according to claim 3, wherein said thumb wheel has indexing means thereon for selective indexing to multiple positions.

5. A model vehicle control system according to claim 1, wherein said tip end has decreased flexibility and is axially slidably coupled to said connector;
and biasing means between said tip end and said connector for maintaining tension on said cables.

6. A model vehicle control system according to claim 1, wherein said connector includes a bracket having a pivotal mounting for attachment to the vehicle, a cable guiding roller rotatably mounted in said bracket, a fork pivotally attached to said bracket on an axis perpendicular to the pivotal axis of the bracket and adjacent the path of the cables around the roller;
a sleeve extending from said fork, said tip end being axially slidably held in said sleeve, and a spring in said sleeve between the tip end and the fork for maintaining tension on said cables.

* * * * *